United States Patent [19]

Fujimoto

[11] 4,410,333

[45] Oct. 18, 1983

[54] STABLE AND HOMOGENEOUS FUEL COMPOSITION FOR INTERNAL COMBUSTION ENGINE AND PROCESS FOR PREPARING THE SAME

[75] Inventor: Shigenobu Fujimoto, Kamakura, Japan

[73] Assignee: Daishin Sangyo Kabushiki Kaisha, Kamakura, Japan

[21] Appl. No.: 362,476

[22] Filed: Mar. 26, 1982

[30] Foreign Application Priority Data

Mar. 31, 1981 [JP] Japan ..... 56-48205

[51] Int. Cl.[3] ..... C10L 1/32

[52] U.S. Cl. ..... 44/51; 44/56

[58] Field of Search ..... 44/56, 51; 123/25 E; 366/127; 204/130

[56] References Cited

U.S. PATENT DOCUMENTS

| | | | |
|---|---|---|---|
| 1,622,572 | 3/1927 | Chandler | 44/56 |
| 3,822,119 | 7/1974 | Frech et al. | 44/56 |
| 4,133,847 | 1/1979 | Feuerman | 44/51 |
| 4,154,580 | 5/1979 | Landis | 44/56 |
| 4,227,817 | 10/1980 | Gerry | 366/127 |
| 4,255,158 | 3/1981 | King | 44/56 |
| 4,276,131 | 6/1981 | Feuerman | 44/51 |
| 4,297,172 | 10/1981 | Seuer | 44/56 |
| 4,324,209 | 4/1982 | Gerry | 123/25 E |

*Primary Examiner*—John Doll
*Assistant Examiner*—Y. Harris-Smith
*Attorney, Agent, or Firm*—Walter H. Schneider

[57] ABSTRACT

A stable and homogeneous fuel composition for an internal combustion engine comprising gasoline, an alcohol selected from the group consisting of methanol and ethanol, and water is provided. The composition is prepared by a process which comprises the steps of applying a high-frequency electric current of 500 kHz to 50 MHz to water, mixing said water with an alcohol selected from the group consisting of methanol and ethanol to obtain a mixture, applying a high-frequency electric current of 500 kHz to 50 MHz to said mixture, admixing said mixture with gasoline to obtain an admixture, and applying a high-frequency electric current of 500 kHz to 50 MHz to said admixture, or a process which comprises the steps of applying a high-frequency electric current of 500 kHz to 50 MHz to a mixture of water and an alcohol selected from the group consisting of methanol and ethanol, mixing gasoline with said mixture, and applying a high-frequency electric current of 500 kHz to 50 MHz to the resultant mixture.

9 Claims, No Drawings

STABLE AND HOMOGENEOUS FUEL COMPOSITION FOR INTERNAL COMBUSTION ENGINE AND PROCESS FOR PREPARING THE SAME

BACKGROUND OF THE INVENTION

The present invention relates to a fuel composition for an internal combustion engine and a process for preparing such a fuel composition, and more particularly to a stable and homogeneous fuel composition for an internal combustion engine comprising gasoline, methanol or ethanol and water and to a process for preparing such a fuel composition.

Various investigations have been made to provide a gasoline composition mixed with methanol or ethanol and to develop an internal combustion engine suitable to be operated by the use of such a gasoline composition, with the aim at saving petroleum resources. As to the stability of a gasoline composition mixed with methanol or ethanol, it has been known that the composition can be preserved as a stable and homogeneous mixture as far as water is not present in the composition and that even if a very small quantity of water is present in the composition, phase separation of gasoline and an alcohol results and homogeneity of the composition is broken so that gasoline moves to form the upper layer and alcohol and water moves to form the lower layer.

On the other hand, in a high output internal combustion engine, it has been made to inject water into gasoline before it is taken into the cylinders in order to improve the performance and combustion efficiencies of the engine. Also, an experimental result has been reported, wherein the combustion efficiency of the fuel is improved by 10 to 20% and the amount of exhaust carbon monoxide is reduced by 20 to 50% by using a mixed fuel composition in an automobile engine, the mixed fuel composition being prepared by mixing gasoline with water by the aid of an emulsifier. It has been thus known that the addition of water is advantageous provided that the mixture of water and gasoline is present as a stable and homogeneous mixture.

An object of this invention is to provide a stable and homogeneous gasoline composition containing methanol or ethanol in order to save petroleum resorces and also containing water in order to realize the aforementioned advantages obtainable by the addition of water.

Another object of this invention is to provide a process for preparing the aforementioned gasoline composition.

SUMMARY OF THE INVENTION

A stable and homogeneous fuel composition for an internal combustion engine according to this invention comprises gasoline, an alcohol selected from the group consisting of methanol and ethanol, and water.

A process for preparing a stable and homogeneous fuel composition for an internal combustion engine, according to this invention, comprises the steps of applying a high-frequency electric current of 500 kHz to 50 MHz to water, mixing said water with an alcohol selected from the group consisting of methanol and ethanol to obtain a mixture, applying a high-frequency electric current of 500 kHz to 50 MHz to said mixture, admixing said mixture with gasoline to obtain an admixture, and applying a high-frequency electric current of 500 kHz to 50 MHz to said admixture.

Another process for preparing a stable and homogeneous fuel composition for an internal combustion engine, according to this invention, comprises the steps of applying a high-frequency electric current of 500 kHz to 50 MHz to a mixture of water and an alcohol selected from the group consisting of methanol and ethanol, mixing gasoline with said mixture, and applying a high-frequency electric current of 500 kHz to 50 MHz to the resultant mixture.

DETAILED DESCRIPTION OF PREFERRED EMBODIMENTS

In the present invention, it is preferred that the alcohol used is ethanol and that the mixing ratio of gasoline, ethanol and water is such that 10 to 50 vol.% of ethanol based on the volume of gasoline and 1 to 10 vol.% of water based on the volume of ethanol are mixed with gasoline. If the amount of alcohol is smaller than the range defined as above, the object of saving petroleum resources becomes declined; whereas if the amount of alcohol is larger than the range as defined above, the resultant composition is an alcohol fuel in substance and is out of accord with the object of providing a gasoline fuel. The advantages obtainable by the addition of water, as aforementioned, is rendered less effective, if the amount of water is smaller than the range as defined above; whereas the stability, particularly the stability at a low temperature, of the resultant fuel composition becomes poor, if the amount of water is larger than the range defined as above.

EXAMPLE 1

A high-frequency electric current of 1200 kHz was applied to city water for 24 minutes. Methanol of fuel grade or ethanol for industrial use was mixed and agitated with the thus treated water to obtain a mixture to which a high-frequency electric current of 1200 kHz was applied for 17 minutes. The mixture was mixed and agitated with a motor gasoline (leadless gasoline) to obtain an admixture to which a high-frequency electric current of 1200 kHz was applied for 25 minutes. The relative mixing ratios of gasoline, methanol or ethanol and water are shown in the following Tables 1 and 2 (50 compositions are shown).

Two samples were taken from each of the thus prepared fuel compositions, and one sample (from each of 50 compositions) was allowed to stand stationarily in a room and the other sample (from each of 50 compositions) was allowed to stand stationarily in a refrigerated chamber (maintained at −17° C.). After one week, the samples were checked to know whether they were separated or not. The results are shown in Tables 1 and 2. In Tables 1 and 2, the mark 0 shows that no separation was observed even after the samples were allowed to stand stationarily both in a room of normal temperature and in a refrigerated chamber, whereas the mark Δ shows that the sample allowed to stand stationarily in the room of normal temperature was not separated but the sample allowed to stand in the refrigerated chamber was separated.

TABLE 1

| | | Relative Ratio of Ethanol to Gasoline, Vol. % | | | | |
|---|---|---|---|---|---|---|
| | | 10 | 15 | 20 | 30 | 50 |
| Relative Ratio of | 2 | O | O | O | O | O |
| Water to Ethanol | 5 | O | O | O | O | O |
| Vol. % | 7 | O | O | O | O | O |

TABLE 1-continued

| | | Relative Ratio of Ethanol to Gasoline, Vol. % | | | | |
|---|---|---|---|---|---|---|
| | | 10 | 15 | 20 | 30 | 50 |
| | 10 | O | Δ | Δ | Δ | Δ |
| | 12 | Δ | Δ | Δ | Δ | Δ |

TABLE 2

| | | Relative Ratio of Methanol to Gasoline, Vol. % | | | | |
|---|---|---|---|---|---|---|
| | | 10 | 15 | 20 | 30 | 50 |
| Relative Ratio | 0.5 | O | O | O | O | O |
| of Water to | 1 | O | O | O | O | O |
| Methanol | 2 | Δ | O | O | O | O |
| Vol. % | 3 | Δ | Δ | Δ | Δ | Δ |
| | 5 | Δ | Δ | Δ | Δ | Δ |

COMPARATIVE EXAMPLE

Methanol of fuel grade or ethanol for industrial use was mixed and agitated with city water and then the obtained mixture was mixed and agitated with a motor gasoline (leadless gasoline) so that the relative mixing ratio of gasoline, methanol or ethanol and water was the same as those for the composition set forth in Tables 1 and 2. All of the mixtures (50 compositions) were separated after they were allowed to stand stationarily for 10 minutes.

EXAMPLE 2

Methanol of fuel grade or ethanol for industrial use was mixed and agitated with city water to obtain a mixture to which a high-frequency electric current of 1200 kHz was applied for 35 minutes, and the mixture was mixed and agitated with a motor gasoline (leadless gasoline) followed by applying a high-frequency electric current of 1200 kHz to the mixture for 25 minutes. The relative mixing ratio of gasoline, methanol or ethanol and water was the same as set forth in Tables 1 and 2.

The stabilities of the thus prepared fuel composition were tested by the same test methods as described in Example 1 to obtain similar results.

REFERENCE EXAMPLE

A fuel composition composed of a gasoline, 15 vol.% of ethanol based on the volume of gasoline and 5% of water based on the volume of ethanol was prepared in accordance with the procedure of Example 1. The thus prepared fuel composition and the pure gasoline were used to operate an internal combustion engine, and the number of revolutions of the engine and the concentrations of HC and CO in the exhaust gas were tested. The details of the test are set forth below:

Engine Model Used: Mitsubishi Gallan 4G32

Tester Used: Model HC-4 & HC-5 Approved by the Ministry of Transport (Japan)

Hydrocarbon Detector: MEXA-221 & MEXA-222

Classification Type: MEXA-341

Classification Designation: Complex Detector for Hydrocarbon

Classification Group: G-1.

The test results are shown as follows:

| | Pure Gasoline | Mixed Composition Described Above |
|---|---|---|
| HC, ppm | 250 | 250 |
| CO, ppm | 0.25 | 0.15 |
| Number of Revolutions, rpm | 520 | 500 |

As will be apparent from the Table set forth above, the concentration of CO was reduced by 40% although the concentration of HC was not changed. Further, the number of revolutions under unloaded condition was reduced by 3.8%.

What is claimed is:

1. A process for preparing a stable and homogeneous fuel composition for an internal combustion engine, comprising the steps of applying a high-frequency electric current of 500 kHz to 50 MHz to water, mixing said water with an alcohol selected from the group consisting of methanol and ethanol to obtain a mixture, applying a high-frequency electric current of 500 kHz to 50 MHz to said mixture, admixing said mixture with gasoline to obtain an admixture, and applying a high-frequency electric current of 500 kHz to 50 MHz to said admixture.

2. The process as set forth in claim 1, wherein said alcohol is ethanol and wherein the mixing ratio of gasoline, ethanol and water is such that 10 to 50 vol.% of ethanol based on the volume of gasoline and 1 to 10 vol.% of water based on the volume of ethanol are mixed with gasoline.

3. A process for preparing a stable and homogeneous fuel composition for an internal combustion engine, comprising the steps of applying a high-frequency electric current of 500 kHz to 50 MHz to a mixture of water and an alcohol selected from the group consisting of methanol and ethanol, mixing gasoline with said mixture, and applying a high-frequency electric current of 500 kHz to 50 MHz to the resultant mixture.

4. The process as set forth in claim 3, wherein said alcohol is ethanol and wherein the mixing ratio of gasoline, ethanol and water is such that 10 to 50 vol.% of ethanol based on the volume of gasoline and 1 to 10 vol.% of water based on the volume of ethanol are mixed with gasoline.

5. The process as set forth in claim 1 wherein said alcohol is methanol and the mixing ratio of gasoline, methanol and water is such that 10 to 50 vol.% of methanol based on the volume of gasoline and 1 to 3 vol.% of water based on the volume of methanol are mixed with gasoline.

6. The process as set forth in claim 3 wherein said alcohol is methanol and the mixing ratio of gasoline, methanol and water is such that 10 to 50 vol.% of methanol based on the volume of gasoline and 1 to 3 vol.% of water based on the volume of methanol are mixed with gasoline.

7. A stable and homogeneous fuel composition for an internal combustion engine comprising gasoline, 10 to 50 vol.% of an alcohol selected from methanol and ethanol based on the volume of said gasoline, and 1 to 3 vol.% of water based on the volume of alcohol when said alcohol is methanol and 1 to 10 vol.% when said alcohol is ethanol, the components of said composition having been subjected to a high frequency electric current of 500 kHz to 50 MHz.

8. A composition according to claim 7 in which a mixture of said alcohol and water has been subjected to a high frequency of electric current of 500 kHz to 50 MHz before being mixed with said gasoline, and in which the resultant gasoline mixture has been similarly treated.

9. A composition according to claim 8 in which said water has been separately subjected to a high frequency electric current of 500 kHz to 50 MHz before being mixed with said alcohol.

* * * * *